US005346372A

United States Patent [19]

Naruse et al.

[11] Patent Number: 5,346,372

[45] Date of Patent: Sep. 13, 1994

[54] FLUID FLOW REGULATING DEVICE

[75] Inventors: Yoshihiro Naruse, Ichikawa; Mitsuhiro Ando, Tokyo; Tomokimi Mizuno, Ichikawa; Naomasa Nakajima, Tokyo, all of Japan

[73] Assignee: Aisin Seiki Kabushiki Kaisha, Kariya, Japan

[21] Appl. No.: 161,065

[22] Filed: Dec. 3, 1993

Related U.S. Application Data

[63] Continuation of Ser. No. 914,745, Jul. 20, 1992, abandoned.

[30] Foreign Application Priority Data

Jul. 18, 1991 [JP] Japan ..... 3-178482

[51] Int. Cl.[5] ..... F04B 17/00

[52] U.S. Cl. ..... 417/379; 251/11

[58] Field of Search ..... 417/53, 379, 474; 60/530; 251/11

[56] References Cited

U.S. PATENT DOCUMENTS

| | | | |
|---|---|---|---|
| 4,512,371 | 4/1985 | Drzewiecki et al. | 251/11 |
| 4,637,071 | 1/1987 | Pitt et al. | 251/11 |
| 4,824,073 | 4/1989 | Zdeblick | 60/530 X |
| 4,938,742 | 7/1990 | Smits | 417/413 B |

OTHER PUBLICATIONS

Judy et al., "Surface-Machined Micromechanical Membrane Pump", IEEE Micro-Electro-Mechanical-Systems (1991), pp. 182-186.

Shoji et al., "Micropump and Sample-Injector for Integrated Chemical Analyzing Systems", Sensors and Actuators (1990), pp. 189-192.

"Device for Controlling the Fluid-Flow Such as Micro Pump is Coming in Practice", Nikkei Electronics (No. 480) (1989), pp. 135-139 with a copy of an English abstract.

F. C. M. van de Pol et al., "A Thermopneumatic Micropump Based on Microengineering Techniques", Jun. 1989, pp. 198-202.

*Primary Examiner*—Louis J. Casaregola
*Assistant Examiner*—Michael I. Kocharov
*Attorney, Agent, or Firm*—Finnegan, Henderson, Farabow, Garrett & Dunner

[57] ABSTRACT

A fluid-flow regulating device is comprised of (a) a plurality of driving mechanisms each of which has a chamber, a diaphragm disposed at an opening of the chamber, a light-heat conversion substance accommodated in the chamber, and an operating fluid stored in the chamber, (b) a fluid-flow passage along which the plurality of driving mechanisms are arranged in such a manner that each of the diaphragm is opposed to the fluid-flow passage, (c) a plurality of optical fibers corresponding to the plurality of the chambers, and (d) a controller having a plurality of optical sources corresponding to the plurality of optical fibers which are set to be turned on and turned off in order to move an amount of fluid through the fluid-flow passage in any one of the normal and the reverse directions.

7 Claims, 10 Drawing Sheets

FLUID FLOW REGULATING DEVICE

This application is a continuation, of application Ser. No. 07/914,745 filed Jul. 20, 1992, now abandoned.

BACKGROUND OF THE INVENTION

The present invention relates to a fluid-flow regulating device, and in particular to a fluid-flow regulating device to be used as a pumping device or other type device which is driven by a mass change of an operating fluid.

A conventional fluid-flow regulating device to be used as a pumping device is disclosed in an essay under the title of "SURFACE MACHINED MICROMECHANICAL MEMBRANE PUMP" at pages 182–186 of IEEE Micro-Electro-Mechanical-Systems (issued in January, 1991). The conventional device has a fluid-flow passage which is defined between a pair of vertically spaced electrodes, and is so designed as to operate in such a manner that when the plus and the minus terminals of the power supply is connected to both electrodes, respectively, the fluid-flow through the passage is set to be permitted.

However, in the conventional device, for the driving thereof: an electric energy is essential, which results in that such device can not be used as a part of a medical appliance. The reason is that in the medical appliance a device which is operated at a high voltage can not be incorporated from the view point of the absolute prevention of any electric shock to the human body.

SUMMARY OF THE INVENTION

It is, therefore, a primary object of the present invention to provide a fluid-flow regulating device to be used as a pumping device without the foregoing drawback.

In order to obtain the foregoing object, a fluid-flow regulating device is comprised of (1) a plurality of driving mechanisms each of which has a chamber, a diaphragm disposed over an opening of the chamber, a light heat conversion substance accommodated in the chamber and an operating fluid stored in the chamber, (2) a fluid-flow passage along which the plurality of driving mechanisms are arranged in such a manner that each of the diaphragms is opposed to the fluid flow passage, (3) a plurality of optical fibers corresponding to the plurality of the chambers, and (4) a controller having a plurality of optical sources corresponding to the plurality of optical fibers which are set to be turned on and turned off in order to move an amount of fluid through the fluid-flow passage.

BRIEF DESCRIPTION OF THE DRAWINGS

The above and other objects, features and advantages of the present invention will be more apparent and more readily appreciated from the following detailed description of preferred exemplary embodiment of the present invention, taken in connection with the accompanying drawings, in which.

DESCRIPTION OF THE PREFERRED EMBODIMENTS

Embodiments of the present invention will be described hereinunder in detail with reference to the accompanying drawings.

Figure 1:
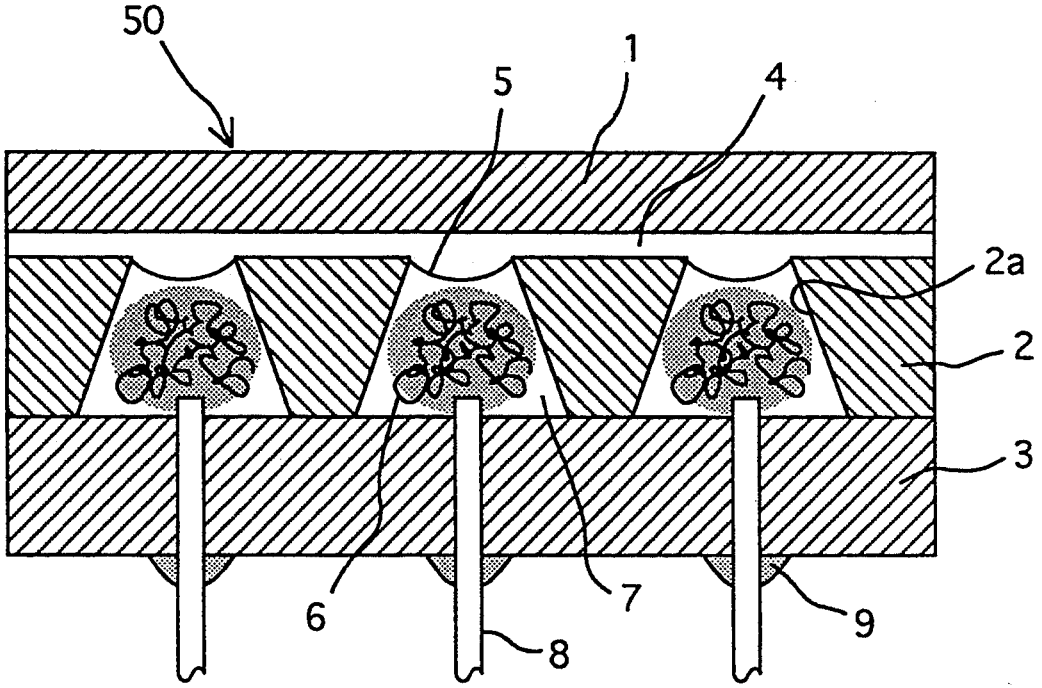
FIG. 1 is a cross-sectional view of a fluid-flow regulating device according to the present invention.
Figure 2:
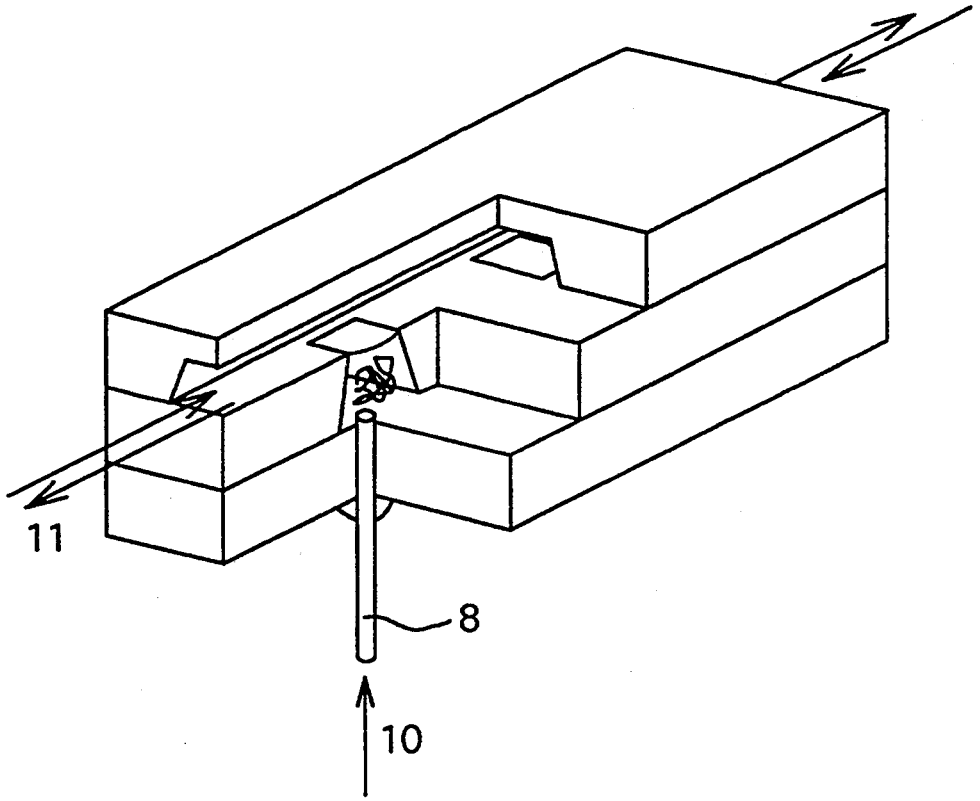
FIG. 2 is a perspective cross-sectional view of the device in FIG. 1.

Referring first to FIGS. 1 and 2, a fluid-flow regulating device 50 is formed into a three-layer structure having an upper plate 1, a middle plate, and a lower plate 3. Although any substance is available as a raw material of each plate, a silicon plate or substrate is preferable as each of the upper plate 1 and the middle plate 2 in light of the fact that these plates should be minute. A fluid-flow passage 4 is provided or formed in the upper plate 1 which is oriented in its lengthwise direction 11. A plurality of chambers **2*a* are formed in the middle plate 2 in such a manner that each chamber 2*a* passes through or penetrates the middle plate 2 in the vertical direction. A thin-film diaphragm 5 is provided at an upper portion of the chamber 2*a*. Although as the thin-film diaphragm 5, any one of a metal membrane, a rubber membrane, and a bimetal membrane is available, the bimetal membrane is most preferable which is bent toward an inner space of the chamber 2*a* due to its previous distortion configuration. In each chamber 2*a*, there provided a light-heat conversion substance 6 and an amount of operating fluid 7. The light-heat conversion substance 6 is a substance such as a carbon fiber by which a light energy is set to be converted into a heat energy. The operating fluid is a substance which is set to be expanded or shrinked in its mass upon supply of the heat energy. The operating fluid is desired to be a gas with a low boiling point which is expanded in its mass when the heat energy is supplied. As this gas, fron-11, fron-113, and ethane are available. A gelationous substance can be used as the operating fluid. In this embodiment, the carbon fiber and the gas with low boiling point are as the light-heat conversion substance 6 and the operating fluid 7, respectively. The lower plate 3 is set to be secured to the middle plate 2 after provisions of the light-heat conversion substance 6 and the operating fluid 7 in each chamber 2*a*. The chambers 2*a* are fluid-tightly closed by the common lower plate 3 and the diaphragm 5**.

A plurality of holes are formed in the lower plate 3 each of which serves for the entrance of an optical fiber 8 into the corresponding chamber 2a. A distal end of the optical fiber 8 is located at a position in the chamber 2a for aiming at the light-heat conversion substance 6. A sealing element 9 which lies between the optical fiber 8 and the lower plate 3 serves for sealing of the chamber 2a. The optical fibers 8a, 8b, and 8c are set to be supplied with light energy from laser diodes LD1, LD2 and LD3.

Figure 3:
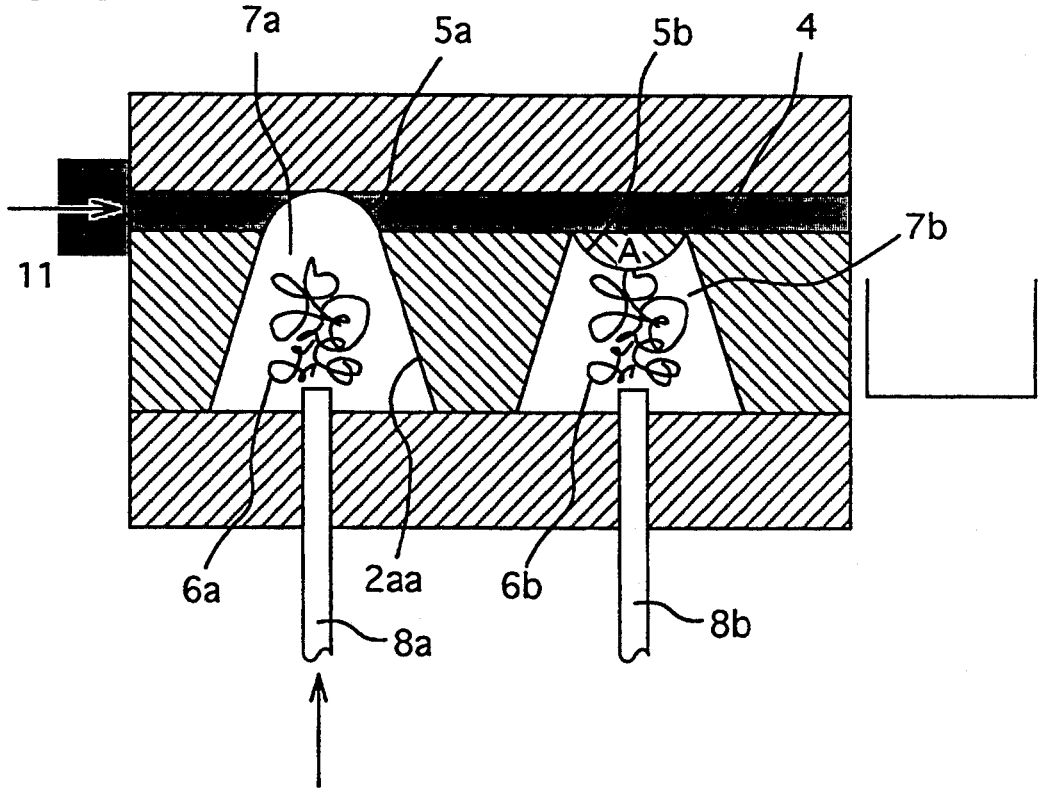
FIG. 3 and FIG. 4 are illustrations each of which show the basic concept how the device acts as a pump.
Figure 4:
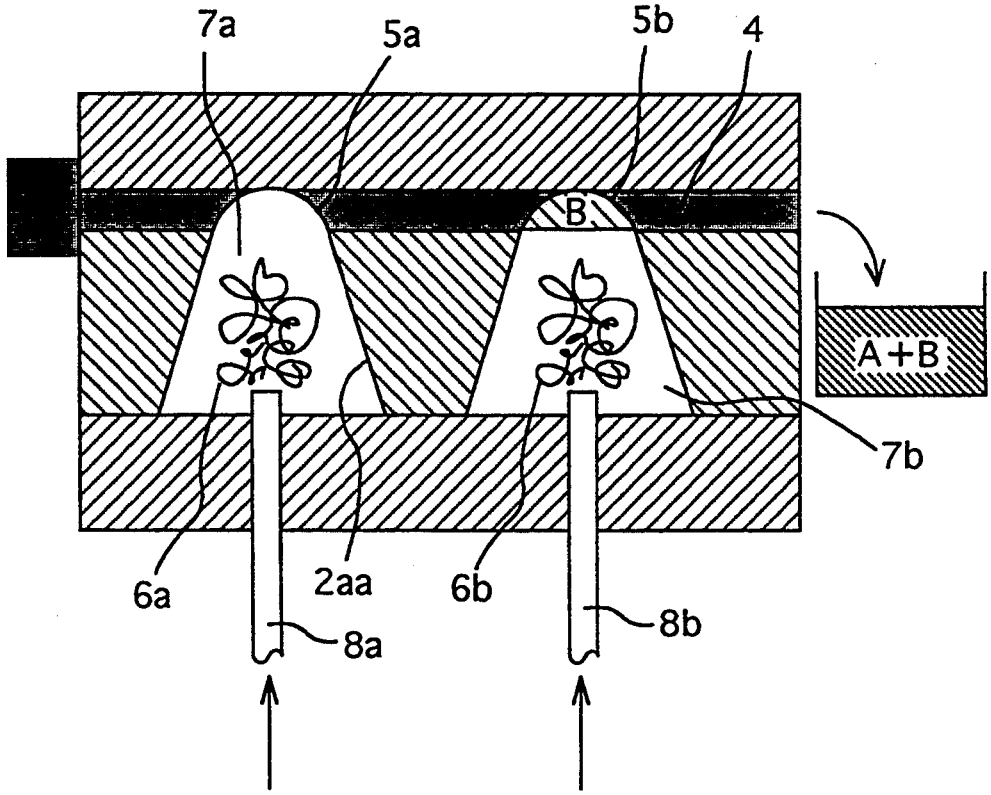

An operation of the foregoing device 50 according to the first embodiment of the present invention is described with reference to FIGS. 3 and 4. FIG. 3 shows a condition under which the optical fiber 8a is being supplied with the light energy but the optical fiber 8b is not so. FIG. 4 shows a condition under which each of the optical fibers 8a and 8b is being supplied with the light energy. In FIG. 3, the light-heat conversion substance 6b in the chamber 2ab is isolated from the light energy, which results in that no heat is generated in the chamber 2ab. Thus, the operating fluid 7a is kept at its steady or stationary condition. On the other hand, in the chamber 2aa, the light-heat conversion substance 6a is being supplied with the light energy via the optical fiber 8a, by which the corresponding heat energy is generated. The resultant heat energy establishes an expansion of the operating fluid 7a in mass, which results in that the diaphragm 5a is bent away from the chamber 2a as illustrated. Thus, the fluid-flow passage 4 is interrupted.

Under the resultant condition, when the optical fiber 8b is supplied with the light energy, the operating fluid 7b in the chamber 2ab is brought into mass expansion, by which the diaphragm 5b is bent away from the chamber 2b as illustrated in FIG. 3. As a whole, the snap action of the diaphragm 5b excludes an amount of fluid which is indicated by "A+B" outside the device 50. This means that the diaphragm 5b acts also as a pump. It is to be noted that the fluid-flow passage 4 is not required to be fully closed by the diaphragm 5a. The reason is that even if the closure of the fluid-flow passage 4 is insufficient, the reduction of the cross-section of the fluid-flow passage 4 which causes the flow restriction of the fluid will decrease the amount of the fluid passing through the passage 4 in the rightward direction. The full closure of the fluid-flow passage 4 will determine the correct or accurate amount of fluid which is to be excluded or discharged at each pumping action.

Figure 5:
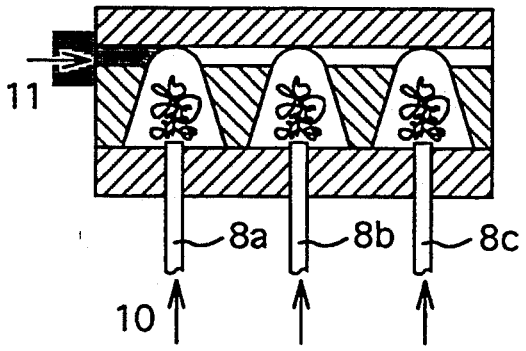
FIGS. 5 through 11 are views showing a sequential operations of the device in FIG. 1.
Figure 9:
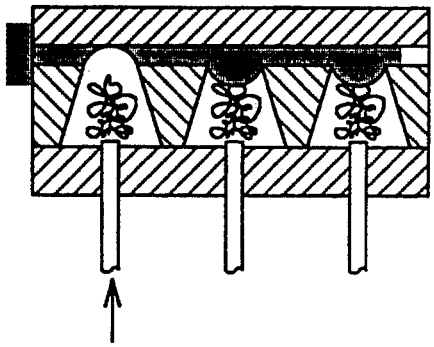
Figure 6:
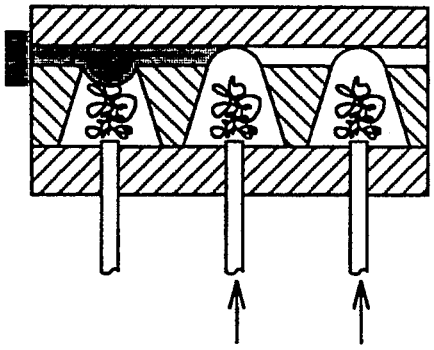
Figure 10:
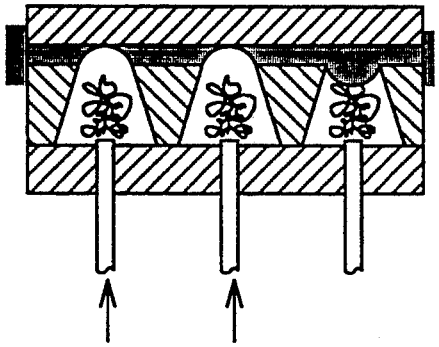
Figure 7:
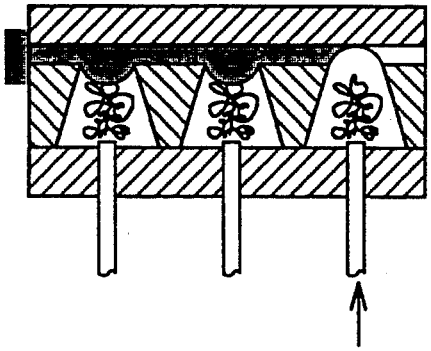
Figure 11:
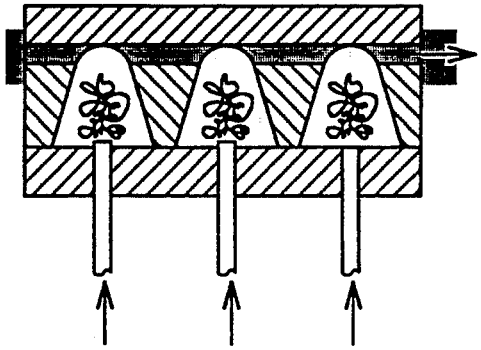
Figure 8:
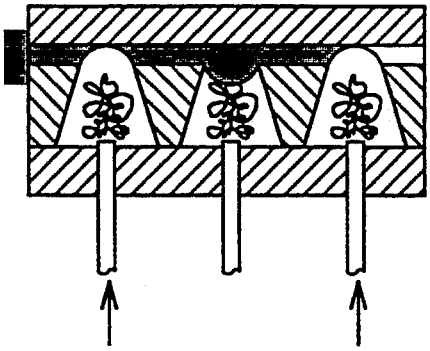
Figure 23:
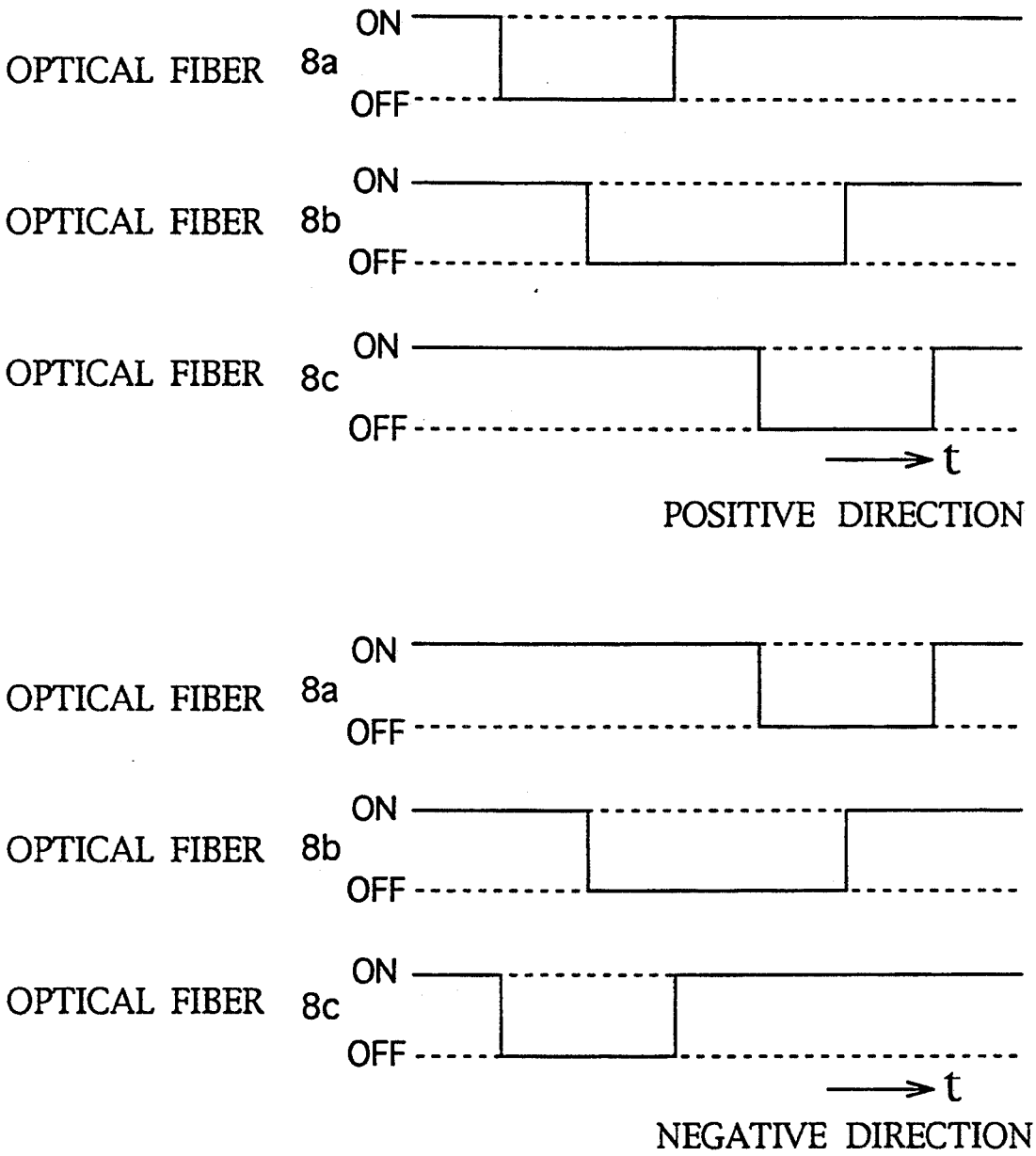
FIG. 23 shows the condition of each optical fiber.

FIGS. 5 through 11 and FIG. 23 show an operation when the device 50 is used as a pump. The terms "positive direction" and "negative direction" mean the rightward direction and the leftward direction, respectively, in each of FIGS. 5, 6, 7, 8, 9, 10, and 11. In order to establish a fluid flow in the positive direction, the following steps are made. That is to say: (a) the light energy is supplied to each of the optical fibers 8a, 8b, and 8c (FIG. 5), (b) the supply of the light energy to the optical fiber 8a is terminated (FIG. 6), (c) the supply of the light energy to the optical fiber 8b is terminated (FIG. 7), (d) the supply of the light energy to the optical fiber 8a is made (FIG. 8), (e) the supply of the light energy to the optical fiber 8c is terminated (FIG. 9), (f) the supply of the light energy to the optical fiber 8b is made (FIG. 10), and (g) the supply of the light energy to the optical fiber 8c is made (FIG. 11). The condition shown in FIG. 5 is identical to the condition shown in FIG. 11. By repeating the foregoing steps (a) through (g), the fluid can be fed or moved in the positive direction. An establishment of the fluid movement in the negative direction can be obtained by replacing the light-supply mode of the optical fiber 8a with that of the optical fiber 8c and vice versa (FIG. 23).

In the foregoing control, if an increase of the amount of the excluded or exhausted fluid is desired for each driving operation, it can be attained by increasing the number of the chambers. The reason is that the amount of fluid to be excluded or exhausted is represented as "A+B" (cf. FIG. 4) which is obtained by a single snap action of each diaphragm.

In detail, on the assumption that a plurality of chambers are formed between the leftmost chamber and the rightmost chamber and each of the chambers are being supplied with the light energy via the respective optical fiber, the increase of the amount of the excluded or exhausted fluid is established by performing the following steps. The mass of the leftmost chamber is decreased by terminating the supply of the light energy thereto (step 1). The supply of the light energy to each of the remaining chambers except for the rightmost chamber is terminated (step 2). The supply of the light energy is established to the leftmost chamber for increasing the mass thereof (step 3). The supply of the light energy to the rightmost chamber is terminated for decreasing the mass thereof, and the supply of the light energy to each chamber except for the leftmost chamber is established in turn from the left to the right (step 5). The repeat of the foregoing steps 1 through 5 will establish the increase of the fluid to be excluded.

Figure 12:
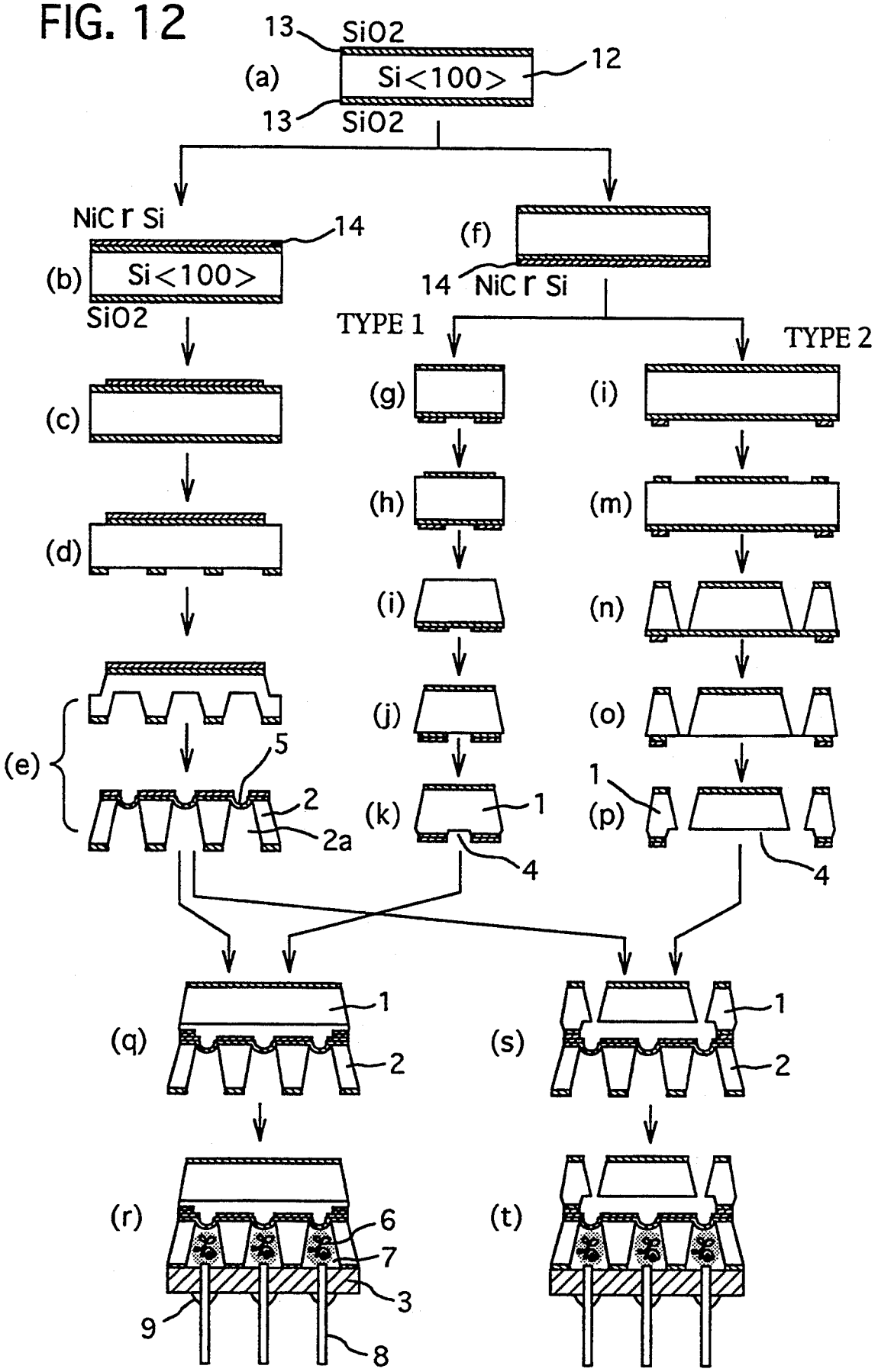
FIG. 12 shows how the device in FIG. 1 and another type device are manufactured.

FIG. 12 shows processes for manufacturing the fluid-flow regulating device. A content of each step is as follows.

(a) A silicon acid film ($SiO_2$) is formed on each surface of a silicon substrate or base plate 12 by means of the oxidation thereon in order to prepare two pieces of the resultant substrates.

(b) A metal film of NiCrSi is formed on the upper silicon acid film by means of the sputtering method.

(c) A patterning is established regarding the metal film and the silicon thin film on the upper surface of the silicon substrate or base plate 12.

(d) Another patterning is established regarding the silicon thin film on the lower surface of the silicon substrate or base plate 12.

(e) An anisotropic etching by using an amount of alkali liquid regarding on each surface side of the silicon substrate or base plate 12 in order to constitute the middle plate 2 having the diaphragm 5, and the chambers 2a. The diaphragm 5 is in the form of two-layer structure which has the metal film and the silicon acid film at which the compression stress and the tension stress, respectively, which results in the bent configuration of the diaphragm 5 toward the respective chamber 2a.

(f) A metal film of NiCrSi is formed on the lower silicon acid film by means of the sputtering method.

(g–k) A patterning and a subsequent etching thereto are established regarding the metal film and the silicon thin film on the lower surface of the silicon substrate or base plate 12 in order to constitute the fluid-flow passage 4 having a pair of openings at its lateral sides thereof which is referred as type 1.

(l–p) A patterning and a subsequent etching thereto are established regarding the metal film and the silicon thin film on the lower surface of the silicon substrate or base plate 12 in order to constitute the fluid-flow passage 4 having a pair of openings at its upper portion thereof which is referred as type 2.

(q) The upper plate 1 obtained at step (k) and the middle plate 2 obtained at the step (e) are combined each other.

(r) The resultant structure in the step (q) is secured at its lower side thereof with the lower plate 3 with optical fibers 8 for sealing each chamber 2*a* after accommodation of the light-heat conversion substance and the operating fluid.

(s) The upper plate 1 obtained at step (p) and the middle plate 2 obtained at the step (s) are combined each other.

(t) The resultant structure in the step (s) is secured at its lower side thereof with the lower plate 3 with optical fibers 8 for sealing each chamber 2*a* after accommodation of the light-heat conversion substance and the operating fluid.

Figure 20:
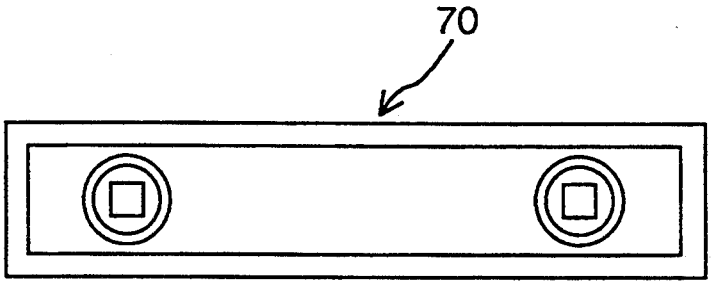
FIG. 20 is a plan view of a fluid-flow regulating device of the third type.
Figure 21:
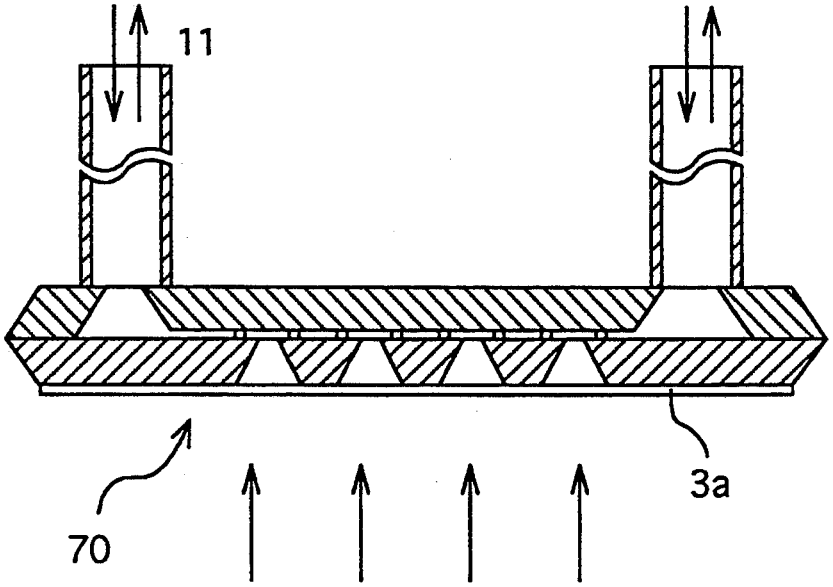
FIG. 21 is a cross-sectional view of the device in FIG. 20.
Figure 22:
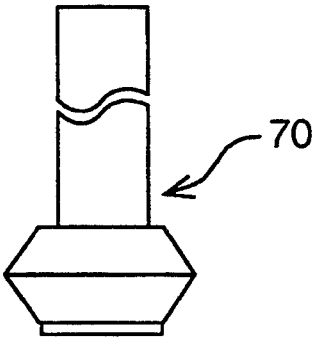
FIG. 22 is a side view of the device in FIG. 20.

Instead of the combination of the upper plate and the middle plate 2, a pair of middle plates 2 are available as shown in FIGS. 20, 21, and 22. In such structure 70, instead of the lower plate 3 with optical fibers, a transparent plate 3*a* is also available.

Figure 13:
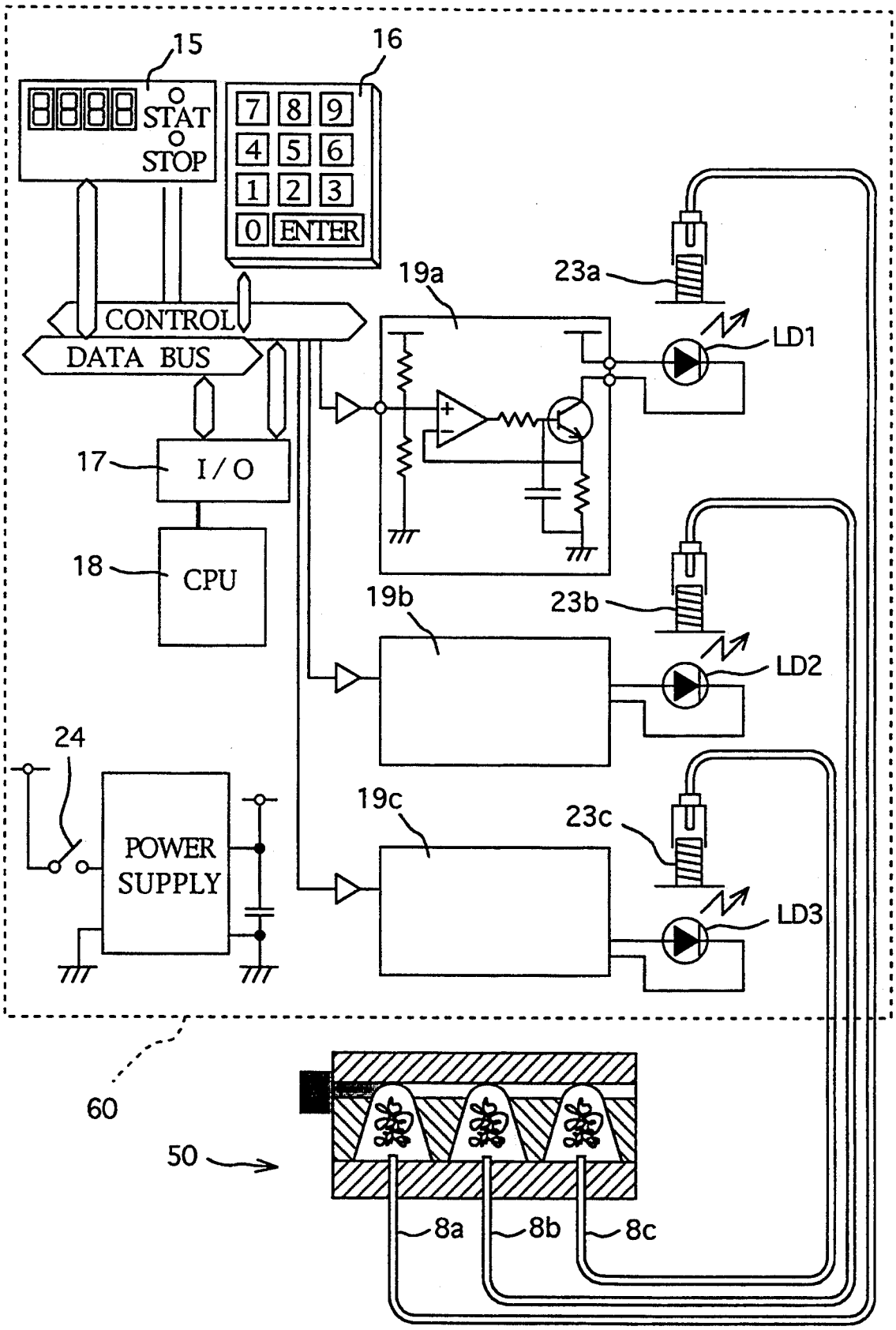
FIG. 13 is a conceptual view of a controller.

FIG. 13 illustrates a controller 60 for controlling the fluid-flow regulating device 50 having three chambers 2*a*. The controller 60 has a data display means 15, a data input means 16, a CPU 18, drivers 19*a*, 19*b*, and 19*c*, laser diodes LD1, LD2, and LD3 which are regarded as input means of the drivers 19*a*, 19*b*, and 19*c*, respectively, photo couplers 23*a*, 23*b*, and 23*c* which are in association with the laser diodes LD1, LD2, and LD3, respectively, via the optical fibers 8*a*, 8*b*, and 8*c*, and other elements. The data input means 16 is to be inputted with information relating to the desired amount of excluded or exhausted fluid, a start time, a termination time, and so on. The display means 15, which is provided with lamps, is set to display the actual amount of excluded or exhausted fluid, the number of the driving, and so on. The display means 15, the data input means 16, and the driver 19 is attach or connected via an I/O 17 as an interface to the CPU 18. The controller 60 is so designed as to be initiated immediately upon closure of the main switch 24. In order to activate the fluid-flow regulating device 50 as a pump as mentioned above, the CPU 18 is set to be operated on the basis a flow-chart shown in FIG. 14.

Figure 14:
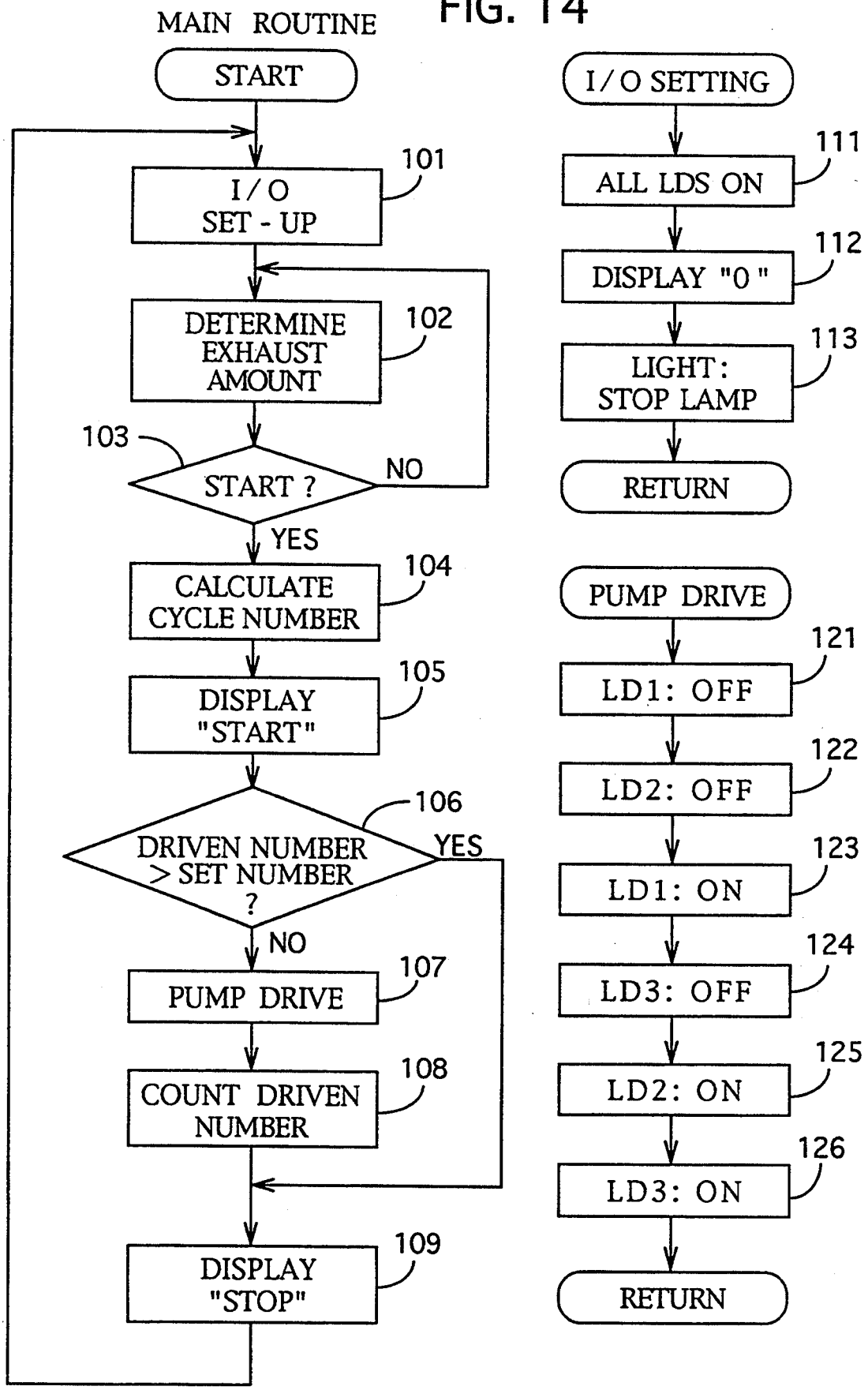
FIG. 14 is a flow-chart for driving a CPU of the controller in FIG. 13 in order to establish the fluid-flow in the positive direction.

In FIG. 14, as soon as a control is initiated, first of all, in an I/O set-up routine is executed at step 101. That is to say, all laser diodes LD1, LD2, and LD3 are turned on in order to establish the light-emission of each laser diode at step 111. Then, "0" is set to be displayed on the display means 15 at step 112, and the stop lamp is lit at step 113. On the basis of the inputted data into the input means 16. amount of fluid to be excluded or exhausted is determined at step 102. Thereafter, with the closure of the start switch, the resultant status is checked at step 103. If the start is confirmed, the cycle number of the device is calculated on the basis of the following formula.

$$\text{Cycle number of the device} = \frac{\text{set amount to be exhausted}}{\text{exhausted amount per single drive}}$$

At step 105, the stop lamp is turned off and the start lamp is lit for the indication of the running condition of the device. The device is brought into operation or driving at a set or determined cycle at steps 106, 107, and 108. At step 106, it is checked whether the driven number or the cycle number as mentioned above exceeds a set value or not. At step 107, the pump drive is established. At step 108, the driven number of the device is counted, and the driven number or the corresponding amount of the exhausted fluid is displayed on the display means 15.

Per each drive or pumping operation of the device, the following procedures are set to be executed.

① Turning off the laser diode LD1
② Turning off the laser diode LD2
③ Turning on the laser diode LD1
④ Turning off the laser diode LD3
⑤ Turning on the laser diode LD2
⑥ Turning on the laser diode LD3

Thus, only the previously determined amount of the fluid is set to to exhausted in the positive direction as described above with reference to FIGS. 5 through 11. After the operation including the foregoing procedures ① through ⑥ are repeated set times, the amount of the exhausted fluid becomes the set or predetermined one. Thereafter, the stop lamp is turned on for the indication of the inoperation of the device at step 109.

Figure 15:
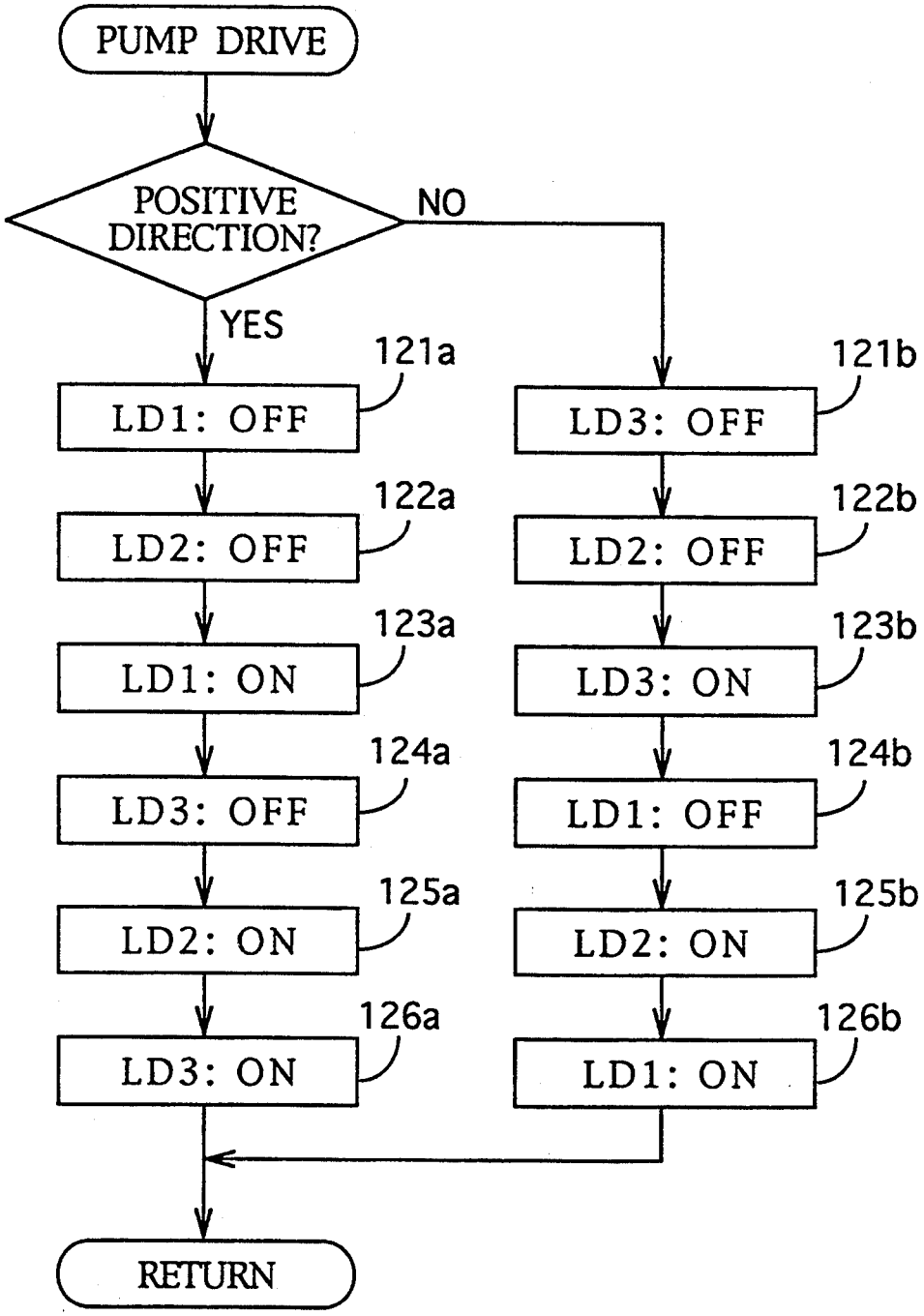
FIG. 15 is another flow-chart for driving the CPU of the controller in FIG. 13 in order to establish any one of the fluid-flow in the positive direction and the fluid-flow in the negative direction.
Figure 16:
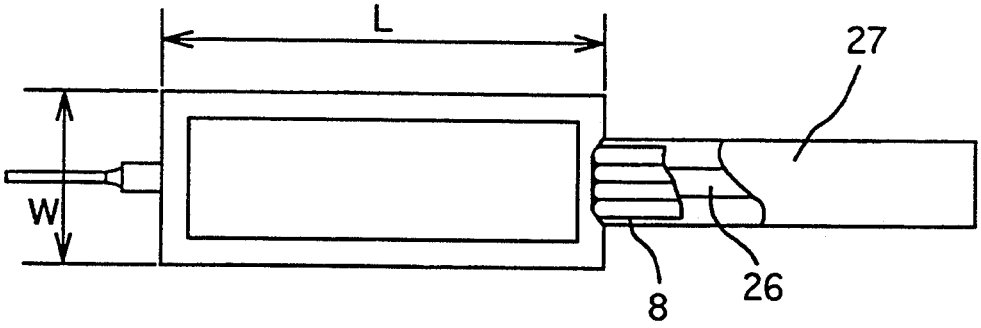
FIG. 16 is a plane view of another fluid-flow regulating device.
Figure 17:
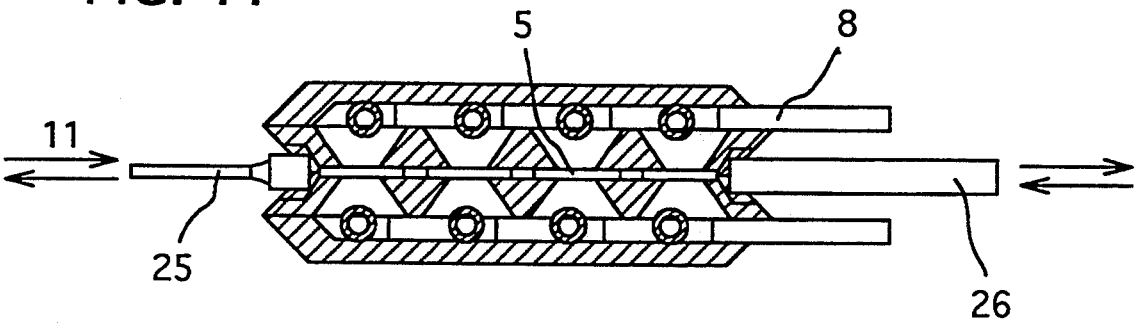
FIG. 17 is a cross-sectional view of the device in FIG. 15.
Figure 18:
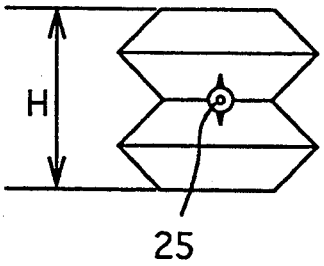
FIG. 18 is a left side view of the device in FIG. 15.
Figure 19:
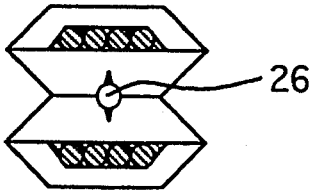
FIG. 19 is a right side view of the device in FIG. 15.

In addition, if the fluid is required to be exhausted in the negative direction as well as the positive direction exhaustion of the fluid, an employment of the flow-chart shown in FIG. 15 can be used for activating the CPU 18. In this procedure, the setting of the direction-positive direction or negative direction- should be established or designated at step 102. In this routine, the following procedures are set to be executed.

① Turning off the laser diode LD3
② Turning off the laser diode LD2
③ Turning on the laser diode LD3
④ Turning off the laser diode LD1
⑤ Turning on the laser diode LD2
⑥ Turning on the laser diode LD1

As apparent from the foregoing descriptions, it is proved that the combination of plural diaphragm operation each of which is set to be individual controlabale will establish various fluid-flow circuits. The pumping operation is one of the examples.

Another type of the pump will be described in brief with reference to FIGS. 16, 17, 18, and 19. In this pump, a plurality of upper diaphragms 5 and a corresponding plurality of lower diaphragms 5 are opposed with each other between which a fluid-flow passage is defined. At both ends of the fluid-flow passage there are provided a needle 25 and a conduit 26. By supplying the light-energy to each optical fiber 8, the pumping operation can be established in order to move the fluid from the needle 25 to the conduit 26 or vise versa.

According to today's silicon technology, the length L, width W, and height of the device can be set at approximately 3 mm, 1 mm, and 1 mm, respectively.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. An optically operated fluid-flow regulating device comprising:

a continuous linear fluid-flow passage;

a plurality of driving mechanisms each having a chamber, a diaphragm disposed at an opening of the chamber so as to be in parallel with the linear fluid-flow passage, a light-heat conversion substance accommodated in the chamber, and an operating fluid stored in the chamber;

a plurality of optical fibers extending respectively at one end into each of the chambers to expose the light-heat conversion substance directly to light at said one end of each fiber; and a controller having a plurality of independently operated optical sources, corresponding in number to the plurality of optical fibers, for emitting light, when turned on, transmitted to said one end of each optical fiber, respectively.

2. A fluid-flow regulating device according to claim 1, wherein the number of the chambers is n to establish a first chamber, a second chamber, . . . and an n-th chamber, and wherein the controller operates steps of (1) turning-on all of the optical sources, (2) turning-off the optical source for the optical fiber extending to the first chamber, (3) turning-off the optical sources for the optical fibers extending to the remaining chambers except for the n-th chamber, (4) turning-on the optical source for the optical fiber extending to the first chamber, (5) turning-off the optical source for the optical fiber extending to the n-th chamber, and (6) turning-on the optical sources for the optical fibers extending to the chambers except for the first chamber in turn.

3. A fluid-flow regulating device according to claim 2, wherein the controller repeats the steps (2) through (6) at set times after execution of the step (1).

4. A fluid-flow regulating device according to claim 1, wherein the number of the chambers is 3, and the controller operates steps of (1) turning-on all optical sources, (2) turning-off the optical source for the optical fiber extending to the first chamber, (3) turning-off the optical source for the optical fiber extending to the second chamber, (4) turning-on the optical source for the optical fiber extending to the first chamber, (5) turning-off the optical source for the optical fiber extending to the third chamber, (6) turning-on the optical source for the optical fiber extending to the second chamber, and (7) turning-on the optical source for the optical fiber extending to the third chamber.

5. A fluid-flow regulating device according to claim 4, wherein the controller operates to repeat the steps (2) through (7) at set times after execution of the step (1).

6. An optically operated fluid-flow regulating device comprising:

a fluid-flow passage;

a plurality of driving mechanisms each having a chamber, a diaphragm disposed at an opening of the chamber and initially flexed toward the chamber so as to establish a snap action outwardly of the chamber and into the fluid-flow passage when pressure in the chamber exceeds a set value, a light-heat conversion substance in the chamber, and an operating fluid in the chamber;

a plurality of optical fibers extending respectively at one end into each of the chambers to expose the light-heat conversion substance directly to light at said one end of each fiber; and a controller having a plurality of independently operated optical sources, corresponding in number to the plurality of optical fibers, for emitting light, when turned on, transmitted to said one end of each optical fiber, respectively.

7. An optically operated fluid-flow regulating device comprising:

an elongated fluid-flow passage of substantially continuous cross-section for a length thereof;

a plurality of driving mechanisms along the length of said fluid-flow passage, each of said driving mechanisms having a chamber adjacent to said fluid-flow passage, a diaphragm separating an opening of the chamber from the fluid-flow passage and initially flexed toward the chamber so as to establish a snap action out of said chamber and into said passage when pressure in the chamber exceeds a set value, a light-heat conversion substance in the chamber, and an operating fluid in the chamber;

a plurality of optical fibers extending respectively into the chambers; and a controller having a plurality of independently operated optical sources corresponding to the plurality of optical fibers.

* * * * *